US011110737B2

(12) United States Patent
Umemura

(10) Patent No.: US 11,110,737 B2
(45) Date of Patent: Sep. 7, 2021

(54) NIB HOLDER

(71) Applicant: Kazumasa Umemura, Numazu (JP)

(72) Inventor: Kazumasa Umemura, Numazu (JP)

( * ) Notice: Subject to any disclaimer, the term of this patent is extended or adjusted under 35 U.S.C. 154(b) by 131 days.

(21) Appl. No.: 16/672,376

(22) Filed: Nov. 1, 2019

(65) Prior Publication Data

US 2021/0129575 A1 May 6, 2021

(51) Int. Cl.
*B43K 3/00* (2006.01)

(52) U.S. Cl.
CPC ..... *B43K 3/005* (2013.01); *B43K 3/00* (2013.01)

(58) Field of Classification Search
CPC ..... B43K 3/005; B43K 3/00; B43K 13/00; B43K 13/005; B43K 13/02; B43K 3/02; B43K 3/04; B43K 17/00; B43K 17/005; B43K 17/01; B43K 17/05; B43K 17/04
USPC ..... 401/249–251
See application file for complete search history.

(56) References Cited

U.S. PATENT DOCUMENTS 2,213,033 A * 8/1940 Ashmore ..... B43K 5/18 401/251
2,811,948 A * 11/1957 Kahn ..... B43K 5/18 401/250
3,292,596 A * 12/1966 Ishida ..... B43K 5/18 401/251

* cited by examiner

*Primary Examiner* — David J Walczak
(74) *Attorney, Agent, or Firm* — John R. Ross; John R. Ross, III

(57) ABSTRACT

A nib holder. The nib holder includes a case having a nib insertion slot. A slider is contained within the case and has a plurality of connection pins and slider connection threads. A pusher is contained within the case and has a plurality of sliding slots. The pusher utilizes the sliding slots to establish a sliding connection to the slider via the slider's connection pins. A stopper is contained within the case. The stopper prevents horizontal motion of the pusher but permits vertical motion of the pusher. An adjuster has adjuster connection threads and utilizes the connection threads to mesh with the connection threads of the slider to establish a threaded connection. A nib is connected to the nib holder by insertion of the nib into the nib insertion slot and then rotation of the adjuster to raise the pusher vertically so that the nib is compressed between the pusher and the case.

4 Claims, 7 Drawing Sheets

NIB HOLDER

This invention relates to dip pens, and in particular, to nib holders for dip pens.

BACKGROUND OF THE INVENTION

Nibs and nib holders are known in the prior art. A nib is a pointed piece of metal that deposits ink onto a writing surface. A nib is mounted onto a nib holder to create a dip pen. Dipping pens are used by writers, artists and drafters for writing, calligraphy, sketching, mapping and technical drawing.

FIG. 1 shows prior art nibs 1 and 2. Nib 2 inserted into nib holder 3 to form dipping pen 5. Nib 2 of dipping pen 5 may be dipped into ink jar 4. Dipping pen 5 can then be used to write onto a paper writing surface.

In the prior art nib 2 is press fit into nib holder 3. Eventually, the attachment can weaken and the nib may become loose within the nib holder. This makes writing difficult and the dipping pen will eventually need to be discarded and replaced with a new functional nib holder. This can be frustrating, inconvenient, expensive and time consuming for the user.

What is needed is a better is a better nib holder.

SUMMARY OF THE INVENTION

The present invention provides a nib holder. The nib holder includes a case having a nib insertion slot. A slider is contained within the case and has a plurality of connection pins and slider connection threads. A pusher is contained within the case and has a plurality of sliding slots. The pusher utilizes the sliding slots to establish a sliding connection to the slider via the slider's connection pins. A stopper is contained within the case. The stopper prevents horizontal motion of the pusher but permits vertical motion of the pusher. An adjuster has adjuster connection threads and utilizes the connection threads to mesh with the connection threads of the slider to establish a threaded connection. A nib is connected to the nib holder by insertion of the nib into the nib insertion slot and then rotation of the adjuster to raise the pusher vertically so that the nib is compressed between the pusher and the case.

DETAILED DESCRIPTION OF THE PREFERRED EMBODIMENTS

Figure 2:
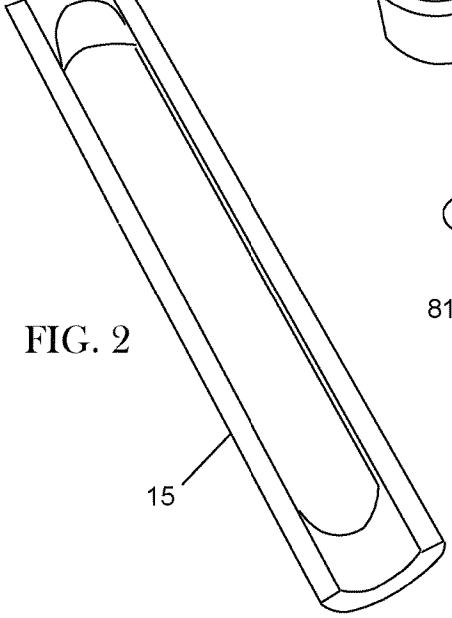
Figure 4:
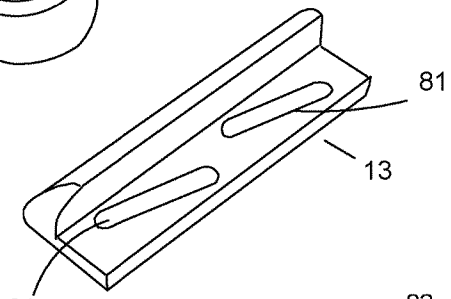
Figure 7:
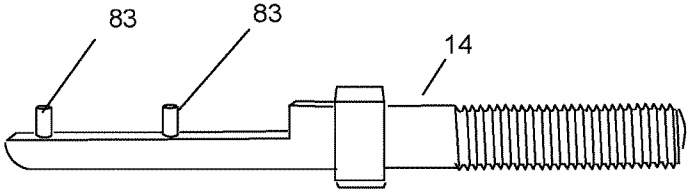

FIGS. 2-7 show components of a preferred embodiment of the present invention: case 10 (FIG. 3), adjuster 11 (FIG. 5), stopper 12 (FIG. 6), pusher 13 (FIG. 4), slider 14 (FIG. 7), and guide 15 (FIG. 2). In one preferred embodiment the components shown in FIGS. 2-7 are fabricated from metal.

Assembly of a Preferred Nib Holder

Figure 8:
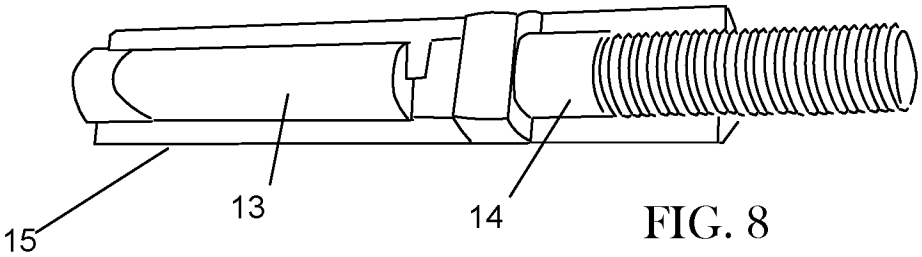
FIGS. 8-13 show a method for assembling a preferred embodiment of the present invention.

In FIG. 8, slider 14 and pusher 13 have been placed inside guide 15. Sliding slots 81 (FIG. 4) of pusher 13 have been aligned with pins 83 of slider 14 so that there is a sliding attachment between both parts.

Figure 9:
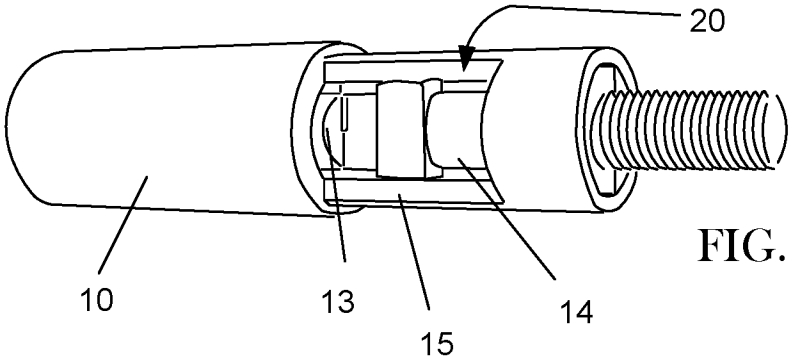

In FIG. 9, slider 14, pusher 13 and guide 15 has been inserted into case 10.

Figure 10:
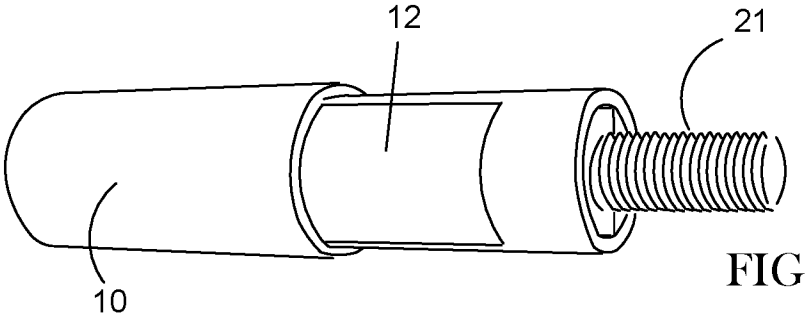

In FIG. 10, stopper 12 has been inserted into gap opening 20 of case 10.

Figure 11:
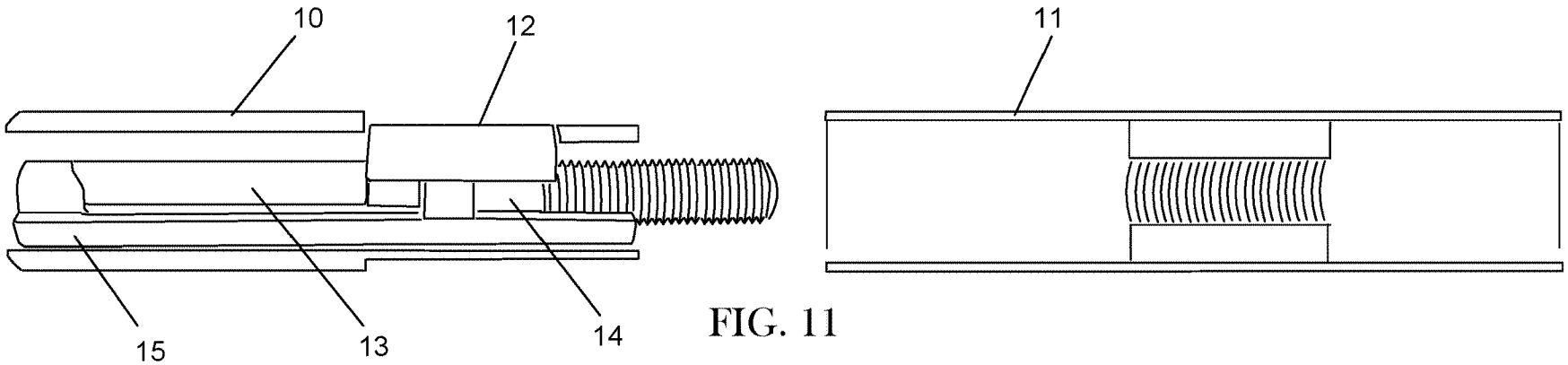

In FIG. 11, adjuster 11 is positioned next to case 10 and is ready for attachment.

Figure 12:
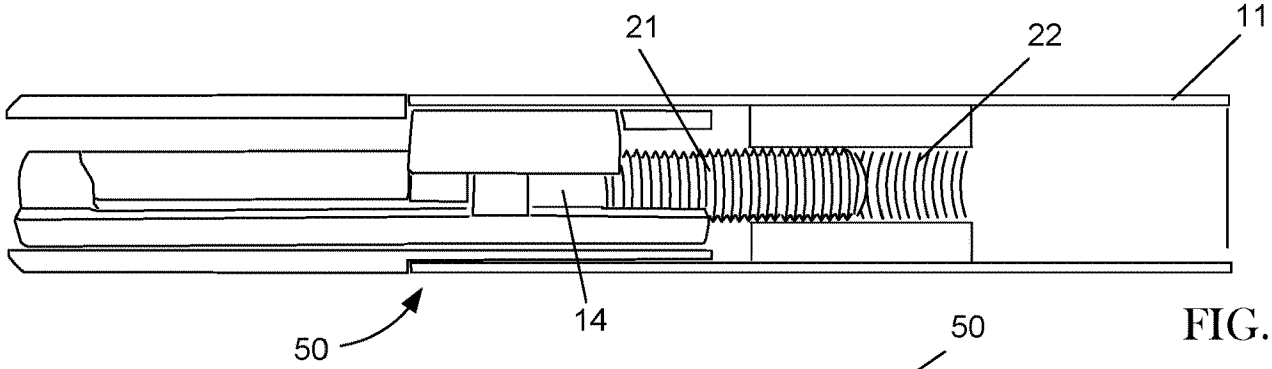
Figure 13:
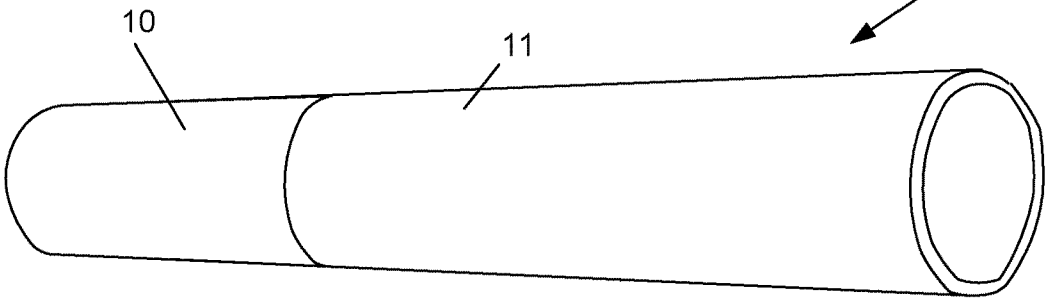

In FIGS. 12-13, threads 22 of adjuster 11 have been threaded onto threads 21 of slider 14 to form nib holder 50.

Installing a Nib into a Preferred Nib Holder

Figure 14:
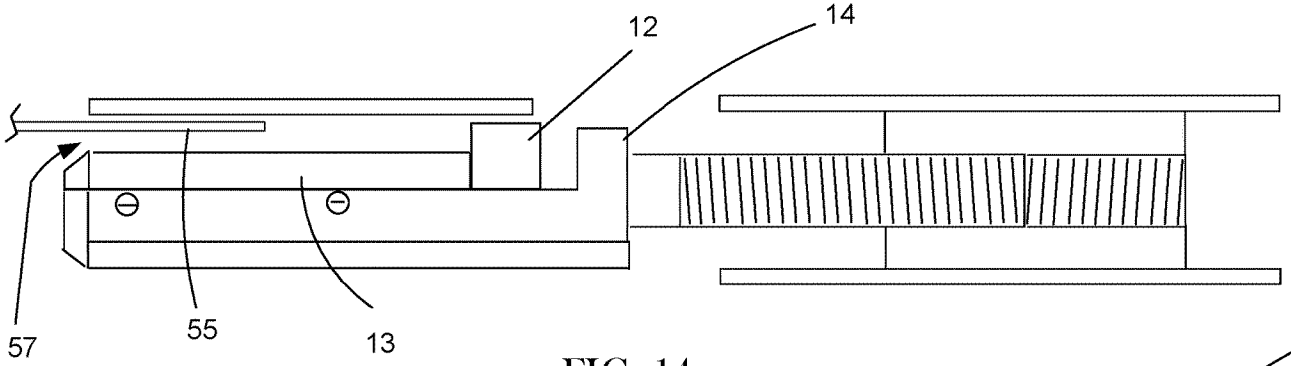
FIGS. 14-18 show a method for insertion of a nib into a preferred nib holder.
Figure 15:
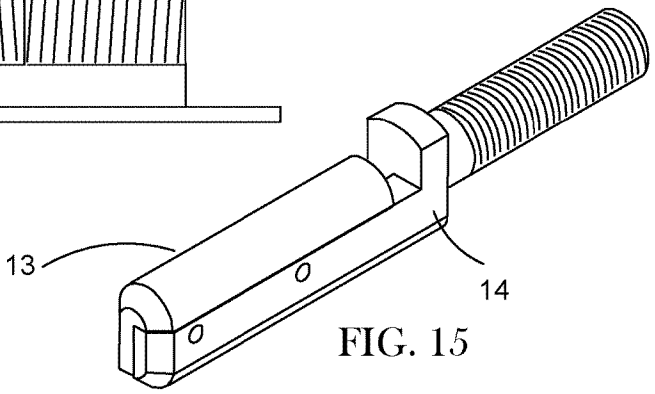

FIGS. 14 and 15 show slider 14, stopper 12 and pusher 13 in the position shown in FIGS. 12-13.

Figure 1:
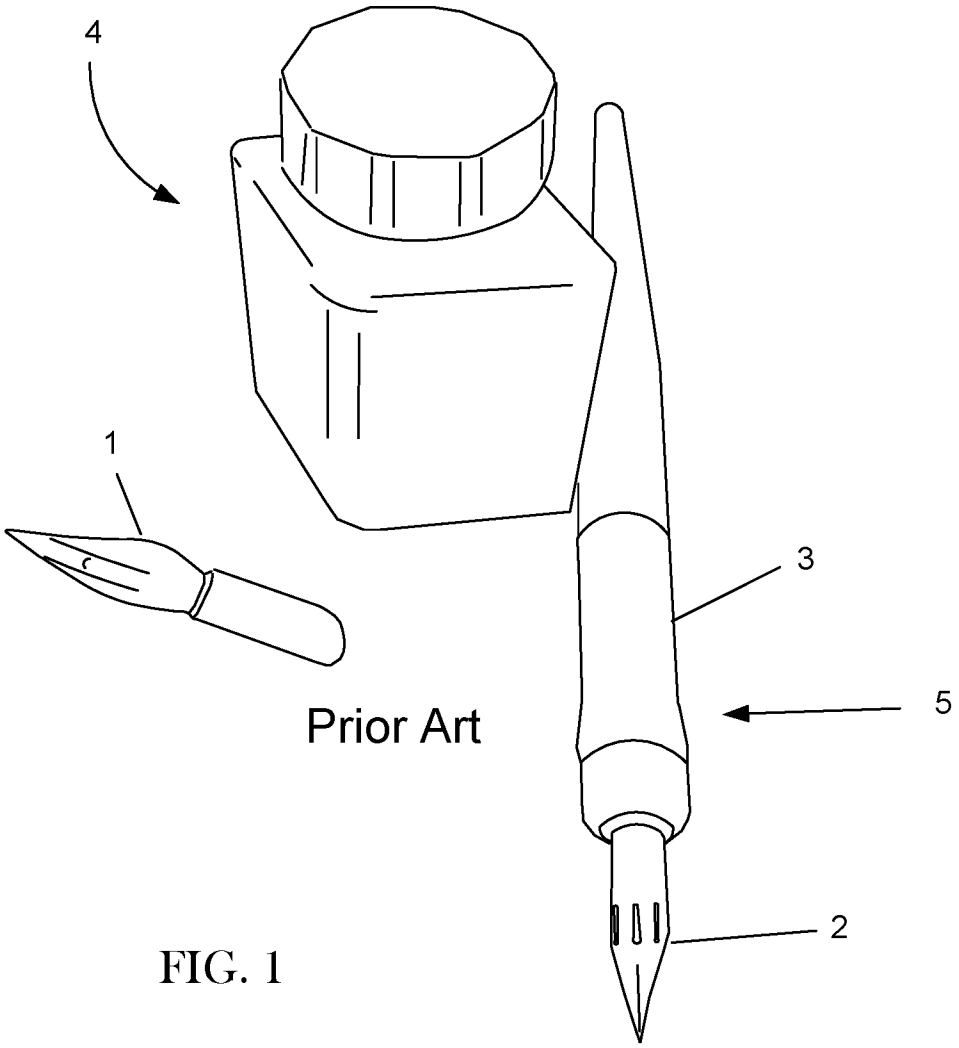
Prior Art FIG. 1
FIG. 1 shows a prior art nib, dipping pen and ink jar.
Figure 3:
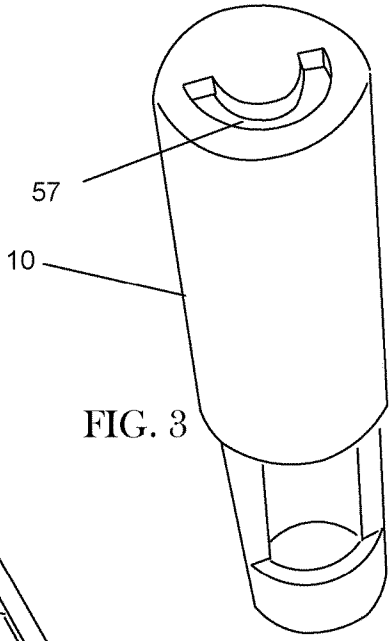
FIGS. 2-7 show components of a preferred embodiment of the present invention.
Figure 5:
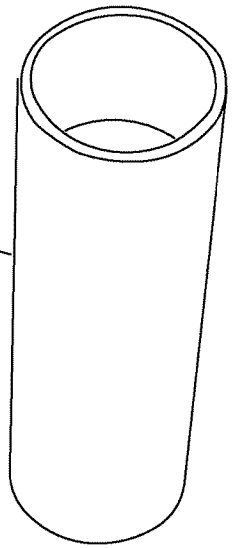
Figure 6:
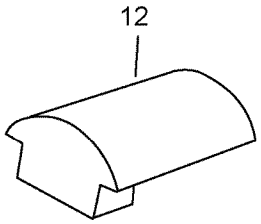

In FIG. 14, a user has inserted Nib 55 into nib insertion slot 57 in case 10, see also FIG. 3.

Figure 16:
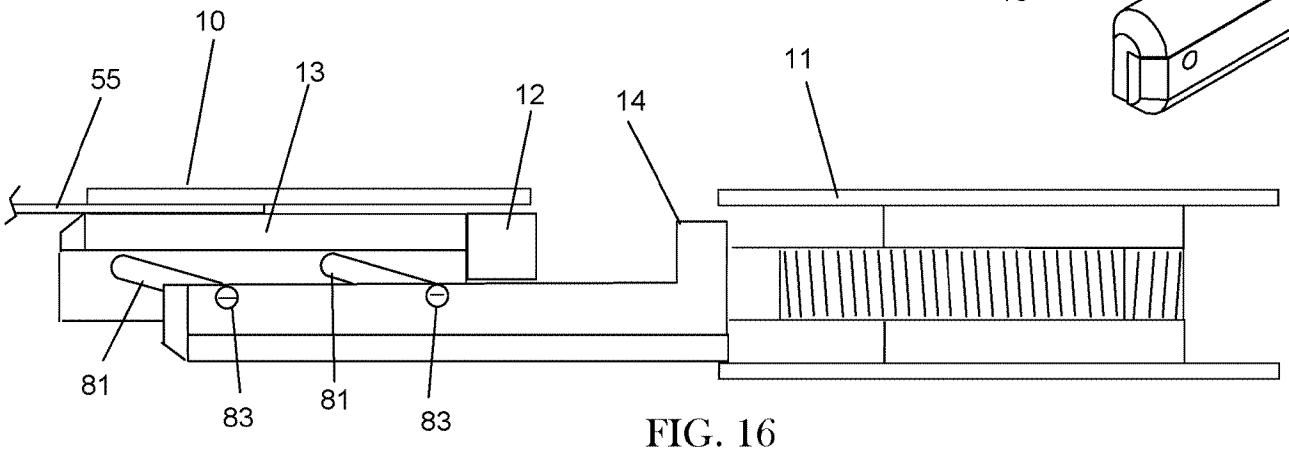
Figure 17:
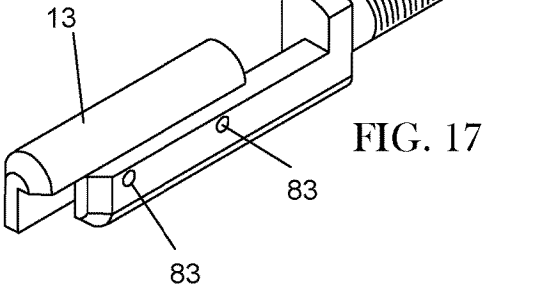

In FIG. 16, the user has rotated adjuster 11 further clockwise thereby causing slider 14 to move rightward. The horizontal rightward motion of pusher 13 is blocked by stopper 12. The rightward motion of slider 14 has caused pins 83 of slider 14 also to move rightward, as shown. Pusher 13 cannot move rightward because its horizontal motion is blocked by stopper 12. However, because pusher 13 is slidingly attached to slider 14 via pins 83, pusher 13 moves vertically upward as shown (see also FIG. 17). Nib 55 is compressed between pusher 13 and case 10, firmly securing nib 55 in place as shown.

Figure 18:
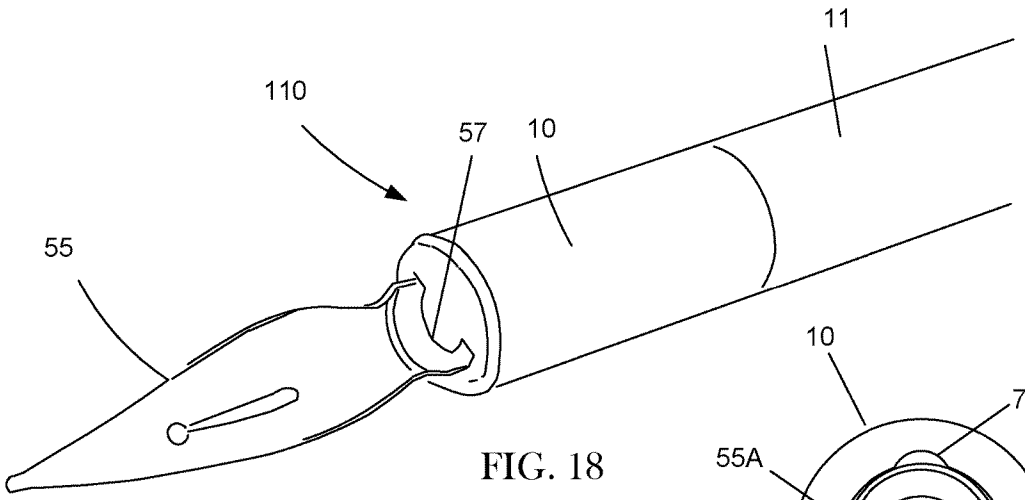

In FIG. 18, nib 55 is firmly held secure within case 10 to form dip pen 110. Dip pen 110 is ready for usage as shown.

FIGS. 19-22 show a front view of case 10. In a preferred embodiment, nib insertion slot 57 includes primary arc 71 and smaller secondary arc 72.

Figure 19:
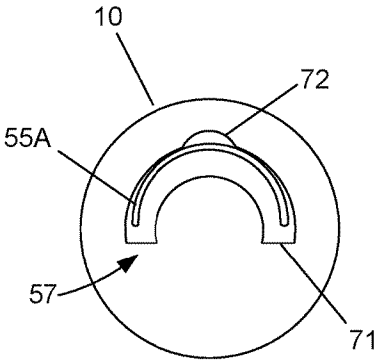
FIGS. 19-22 show a preferred nib insertion slot.
Figure 20:
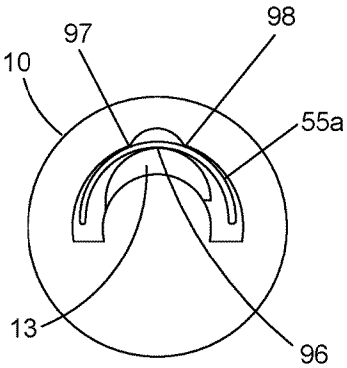

FIG. 19 shows the insertion of thin nib 55A. In FIG. 20, the user has rotated adjuster 11 clockwise causing pusher 13 to rise vertically and compress thin nib 55A between pusher 13 and case 10. The utilization of secondary arc 72 creates three points of contact (96-98) for increased stability.

Figure 21:
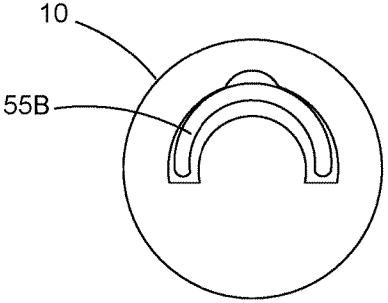
Figure 22:
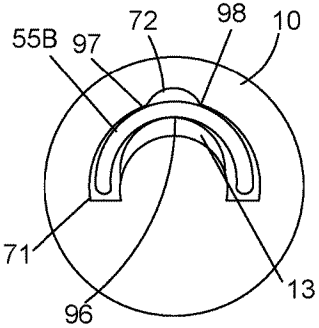

FIG. 21 shows the insertion of thick nib 55B. In FIG. 22, the user has rotated adjuster 11 clockwise causing pusher 13 to rise vertically and compress thick nib 55A between pusher 13 and case 10. The utilization of secondary arc 72 creates three points of contact (96-98) for increased stability.

Other Preferred Embodiment

Figure 23:
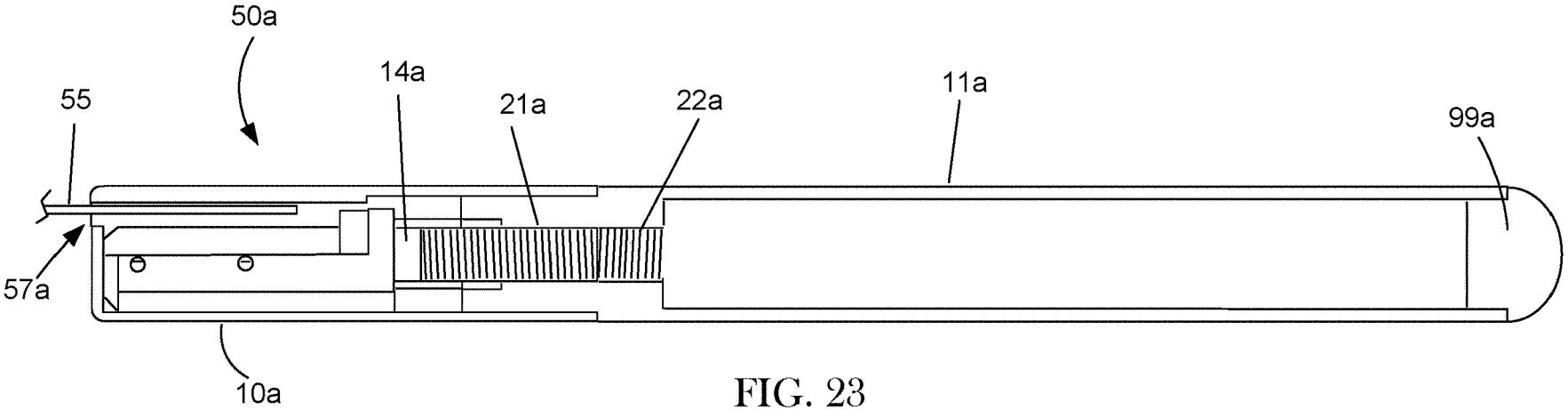
FIGS. 23-24 show another preferred embodiment of the present invention.
Figure 24:
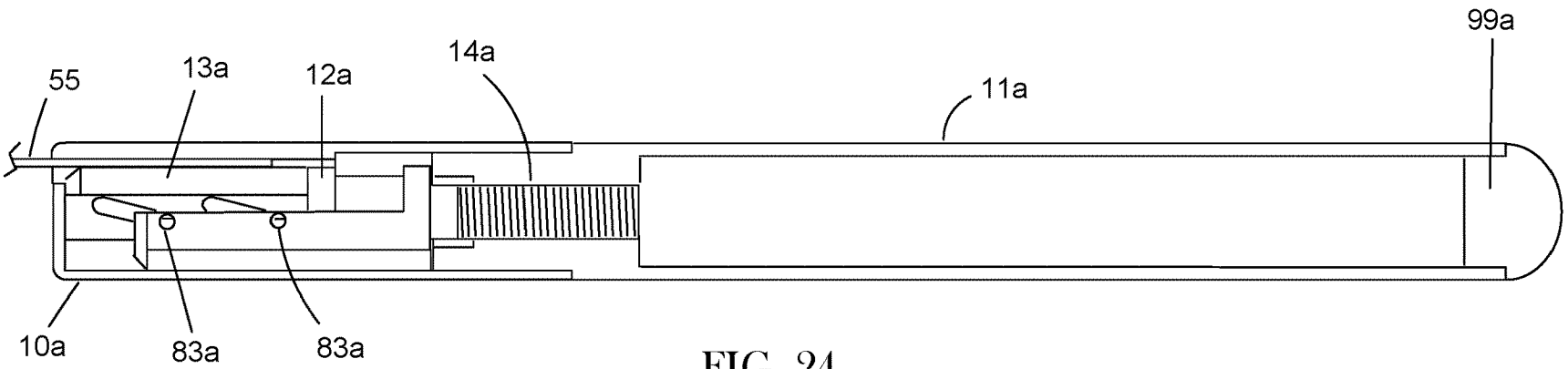

FIGS. 23 and 24 show another preferred embodiment of the present invention.

In FIG. 23, threads 22*a* of adjuster 11*a* have been threaded onto threads 21*a* of slider 14*a* to form nib holder 50*a*. End cap 99*a* has been attached as shown.

In FIG. 23, a user has inserted nib 55 into nib insertion slot 57*a* in case 10*a*.

In FIG. 24, the user has rotated adjuster 11*a* further clockwise thereby causing slider 14*a* to move rightward. The rightward horizontal motion of pusher 13*a* is blocked by stopper 12*a*. The rightward motion of slider 14*a* has caused pins 83*a* of slider 14*a* also to move rightward, as shown. Pusher 13*a* cannot move rightward because its horizontal motion is blocked by stopper 12*a*. However, because pusher 13*a* is slidingly attached to slider 14*a* via pins 83*a*, pusher

13*a* moves vertically upward as shown. Nib 55 is compressed between pusher 13*a* and case 10*a*, firmly securing nib 55 in place as shown.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A nib holder, comprising:

A. a case comprising a nib insertion slot,

B. a slider contained within said case, said slider comprising:

i. a plurality of pins, and ii. slider connection threads,

C. a pusher contained within said case, said pusher comprising a plurality of sliding slots, said pusher sliding connected to said plurality of pins at said plurality of sliding slots, D. a stopper contained within said case, said stopper for preventing horizontal motion of said pusher while permitting vertical motion of said pusher, E. an adjuster comprising connection threads, wherein said adjuster is connected to said slider by a threaded connection between said slider connection threads and said adjuster connection threads, wherein a nib is connected to said nib holder by insertion of said nib into said nib insertion slot and rotation of said adjuster to raise said pusher so that said nib is compressed between said pusher and said case.

2. The nib holder as in claim 1, further comprising a guide for insertion into said case, said guide for containing said slider and said pusher.

3. The nib holder as in claim 1, wherein said nib insertion slot comprises a primary arc and a secondary arc.

4. The nib holder as in claim 3, wherein said primary arc and said secondary arc establish three points of contact for increased stability.

* * * * *